US011846276B2

(12) United States Patent
Wu et al.

(10) Patent No.: US 11,846,276 B2
(45) Date of Patent: Dec. 19, 2023

(54) SUCTION MUFFLER

(71) Applicant: ANHUI MEIZHI COMPRESSOR CO., LTD., Anhui (CN)

(72) Inventors: Wenjie Wu, Anhui (CN); Gang Huang, Anhui (CN)

(73) Assignee: ANHUI MEIZHI COMPRESSOR CO., LTD., Anhui (CN)

( * ) Notice: Subject to any disclaimer, the term of this patent is extended or adjusted under 35 U.S.C. 154(b) by 0 days.

(21) Appl. No.: 17/552,687

(22) Filed: Dec. 16, 2021

(65) Prior Publication Data

US 2022/0170448 A1 Jun. 2, 2022

Related U.S. Application Data

(63) Continuation of application No. PCT/CN2021/084622, filed on Mar. 31, 2021.

(30) Foreign Application Priority Data

Nov. 30, 2020 (CN) ..... 202011383896.8

(51) Int. Cl.
*F04B 39/00* (2006.01)

(52) U.S. Cl.
CPC ..... *F04B 39/0061* (2013.01); *F04B 39/0072* (2013.01)

(58) Field of Classification Search
CPC .. Y10S 181/403; F25B 2500/12; F25B 31/02; F01N 1/02; F01N 1/08; F01N 1/084;
(Continued)

(56) References Cited

U.S. PATENT DOCUMENTS 3,741,336 A * 6/1973 Malosh ..... F01N 1/02 181/266
4,235,304 A * 11/1980 Suyama ..... F01N 1/02 181/272

(Continued)

FOREIGN PATENT DOCUMENTS

CN 203742938 U 7/2014
CN 203879709 U 10/2014

(Continued)

OTHER PUBLICATIONS

International Search Report dated Jun. 29, 2021 issued in PCT/CN2021/084622.

(Continued)

*Primary Examiner* — Dominick L Plakkoottam
(74) *Attorney, Agent, or Firm* — Scully, Scott, Murphy & Presser, P.C.

(57) ABSTRACT

A suction muffler is provided. The suction muffler has a housing assembly, at least one partition plate and a first tube. The housing assembly defines a cavity and has a suction port and a discharge port. The partition plate is provided in the cavity to divide the cavity into at least two muffler cavities. The two muffler cavities each has a first muffler cavity and a second muffler cavity. The partition plate defines a penetrating hole to communicate the first muffler cavity with the second muffler cavity. The suction port corresponds to the first muffler cavity. The first tube has a portion provided in the first muffler cavity. One end of the first tube is in communication with the suction port. The other end of the first tube passes through the partition plate and is in communication with the second muffler cavity.

11 Claims, 3 Drawing Sheets

(58) Field of Classification Search
CPC .... F01N 1/083; F01N 1/089; F01N 2490/155; F01N 1/082; F04B 39/0061; F04B 39/0066; F04B 39/0072
See application file for complete search history.

(56) References Cited

U.S. PATENT DOCUMENTS

| | | | | |
|---|---|---|---|---|
| 4,420,063 | A * | 12/1983 | Bohlmann | F01N 1/12 181/255 |
| 5,647,314 | A | 7/1997 | Matsumura et al. | |
| 7,866,955 | B2 * | 1/2011 | Lilie | F04B 39/0061 181/403 |
| 7,922,460 | B2 * | 4/2011 | Nagao | F04B 39/0061 417/312 |
| 2002/0017425 | A1 * | 2/2002 | Yoon | F04B 39/0061 181/403 |
| 2002/0035844 | A1 * | 3/2002 | Lee | F04B 39/0061 62/296 |
| 2002/0134617 | A1 * | 9/2002 | Nissen | F04B 39/0061 417/312 |
| 2005/0031461 | A1 * | 2/2005 | Lilie | F04B 39/0061 417/902 |
| 2009/0038329 | A1 * | 2/2009 | Alvarenga | F04B 39/0066 62/296 |
| 2009/0257892 | A1 * | 10/2009 | Svendsen | F04B 39/0061 417/312 |
| 2012/0055195 | A1 * | 3/2012 | Wolfe, IV | F28D 7/10 165/96 |
| 2013/0270034 | A1 * | 10/2013 | Wakatsuki | F01N 1/02 181/268 |
| 2017/0218806 | A1 * | 8/2017 | LeRoy | F01N 1/083 |
| 2017/0248131 | A1 | 8/2017 | Stumpf et al. | |
| 2018/0283367 | A1 * | 10/2018 | Cain | F04B 39/005 |

FOREIGN PATENT DOCUMENTS

| | | | | |
|---|---|---|---|---|
| CN | 105649994 | A | 6/2016 | |
| CN | 107989775 | A | 5/2018 | |
| CN | 207406454 | U | 5/2018 | |
| CN | 207777117 | U | 8/2018 | |
| CN | 208982244 | U | 6/2019 | |
| CN | 109469599 | B | 3/2020 | |
| CN | 211008996 | U | 7/2020 | |
| CN | 211009001 | U | 7/2020 | |
| KR | 20080093583 | A | 10/2008 | |
| WO | WO-2016063705 | A1 * | 4/2016 | F01N 1/02 |

OTHER PUBLICATIONS

First Office Action dated Sep. 26, 2022 received in Chinese Patent Application No. CN 202011383896.8.

* cited by examiner

SUCTION MUFFLER

CROSS REFERENCE TO RELATED APPLICATIONS

The present application is a continuation application of PCT International Application No. PCT/CN2021/084622, filed on Mar. 31, 2021, which claims priority to and benefit of Chinese Patent Application Serial No. 202011383896.8, filed Nov. 30, 2020, the entire contents of which are incorporated herein by reference for all purposes. No new matter has been introduced.

FIELD

Embodiments of the present disclosure relate to the field of muffling technologies of compressors, and more particularly, to a suction muffler used in a compressor.

BACKGROUND

Noises of refrigerators mainly come from refrigerator compressors, and the refrigerator compressors are equipped with a muffler to reduce the noises of the refrigerator compressors. The muffler in the related art includes a housing and a partition plate. The partition plate is provided in the housing to divide internal space of the housing into two expansion cavities. The housing is further provided with a suction port and a discharge port. Pulsation of the airflow sucked from the suction port can cause significant disturbance to the airflow in the expansion cavities and even cause resonance in severe cases, which affects muffling effect of the expansion cavities.

SUMMARY

The present disclosure is made by the inventor at least based on discoveries and understandings of the following facts and problems.

In the related art, internal space of a muffler is divided into a left expansion cavity and a right expansion cavity. Taking the case in which a suction port is provided at a side where the left expansion cavity is located as an example, airflow sucked at the suction port will directly enter the left expansion cavity, pulsation of the sucked airflow will cause disturbance to the airflow in the left expansion cavity, which easily causes vibration of the side of the muffler where the left expansion cavity is located, and even causes resonance in severe cases, thereby reducing muffling effect of the muffler.

To address at least the above problem, an embodiment of the present disclosure proposes a suction muffler, which can reduce disturbance of airflow pulsation at the suction port to the airflow in the expansion cavity and further avoid occurrence of resonance. As a result, muffling effect of the suction muffler can be ensured.

The suction muffler according to at least one embodiment of the present disclosure includes a housing assembly, at least one partition plate, and a first tube. The housing assembly defines a cavity and is provided with a suction port and a discharge port. The at least one partition plate is provided in the cavity to divide the cavity into at least two muffler cavities. The at least two muffler cavities include a first muffler cavity and a second muffler cavity, and the at least one partition plate defines a penetrating hole to communicate the first muffler cavity with the second muffler cavity. The suction port corresponds to the first muffler cavity. The first tube has at least a portion provided in the first muffler cavity. One end of the first tube is in communication with the suction port, and the other end of the first tube passes through the at least one partition plate and is in communication with the second muffler cavity.

The suction muffler according to at least one embodiment of the present disclosure reduces disturbance of airflow pulsation at the suction port to the airflow in an expansion cavity, to ensure muffling effect of the suction muffler.

In some embodiments, the suction muffler includes a second tube having at least a portion provided in the second muffler cavity, an end of the second tube is coupled to one partition plate, and the second tube is in communication with the first muffler cavity through the penetrating hole in the at least one partition plate.

In some embodiments, the first tube is a circular tube, and an inner diameter of the first tube is in a range of 6 mm-8 mm. Alternatively or additionally, the second tube is a circular tube, and an inner diameter of the second tube is in a range of 6 mm-8 mm.

In some embodiments, a surface of an inner wall of the housing assembly is provided with a first slot, and a portion of the partition plate is fitted in the first slot.

In some embodiments, an end portion of the first tube is provided with a coupling member, the coupling member is coupled to the housing assembly, and the coupling member defines a communication hole configured to communicate the suction port with the first tube.

In some embodiments, a surface of an inner wall of the housing assembly is provided with a second slot, and a portion of the coupling member is fitted in the second slot.

In some embodiments, the discharge port is in communication with the first muffler cavity, the suction port is located below the discharge port, and in an up-down arrangement direction of the discharge port and the suction port, an end portion of the first tube coupled to the suction port is higher than or located above an end portion of the first tube in communication with the second muffler cavity.

In some embodiments, the suction port is located below the discharge port, and in an up-down arrangement direction of the discharge port and the suction port, the penetrating hole is located above an end portion of the first tube in communication with the second muffler cavity.

In some embodiments, the housing assembly includes a barrel and a cover, a top of the barrel is a top opening, the cover is provided at the top opening of the barrel, the partition plate and the first tube are both provided in the barrel, the suction port is provided to the barrel, and the discharge port is provided to the cover.

In some embodiments, the first muffler cavity has a first length in a direction from the first muffler cavity to the second muffler cavity, the second muffler cavity has a second length in the direction from the first muffler cavity to the second muffler cavity, and a ratio of the first length to the second length is between one-third to two-thirds.

Figure 1:
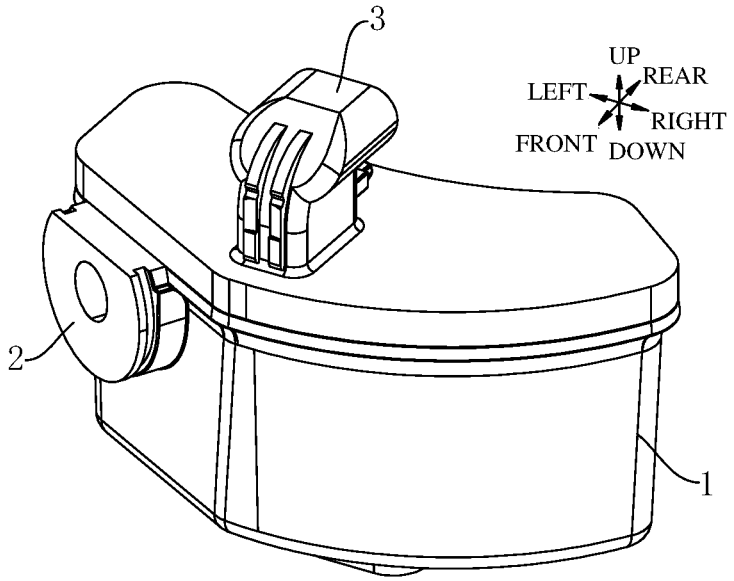
FIG. 1 is a perspective view of a suction muffler according to an embodiment of the present disclosure.

The description of the reference numerals shown in the figures is provided as follows:

housing assembly 1; cover 11; barrel 12; first muffler cavity 13; second muffler cavity 14; first slot 15; second slot 16; third slot 17;

suction port 2;

discharge port 3;

partition plate 4; penetrating hole 41;

first tube 5;

second tube 6;

coupling member 7; communication hole 71.

DETAILED DESCRIPTION OF EMBODIMENTS

Embodiments of the present disclosure will be described in detail below, and examples of the embodiments are shown in accompanying drawings. The embodiments described herein with reference to drawings are explanatory, illustrative, and used to generally understand the present disclosure. The embodiments shall not be construed to limit the present disclosure. In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," "counterclockwise," "axial," "radial" and "circumferential" should be construed to refer to the orientation as then described or as shown in the drawings under discussion. These relative terms are for convenience of description and do not require that the present disclosure be constructed or operated in a particular orientation.

A suction muffler according to embodiments of the present disclosure is described below with reference to FIGS. 1-6.

As illustrated in FIGS. 1-6, a suction muffler according to an embodiment of the present disclosure includes a housing assembly 1, a partition plate 4 and a first tube 5.

Figure 2:
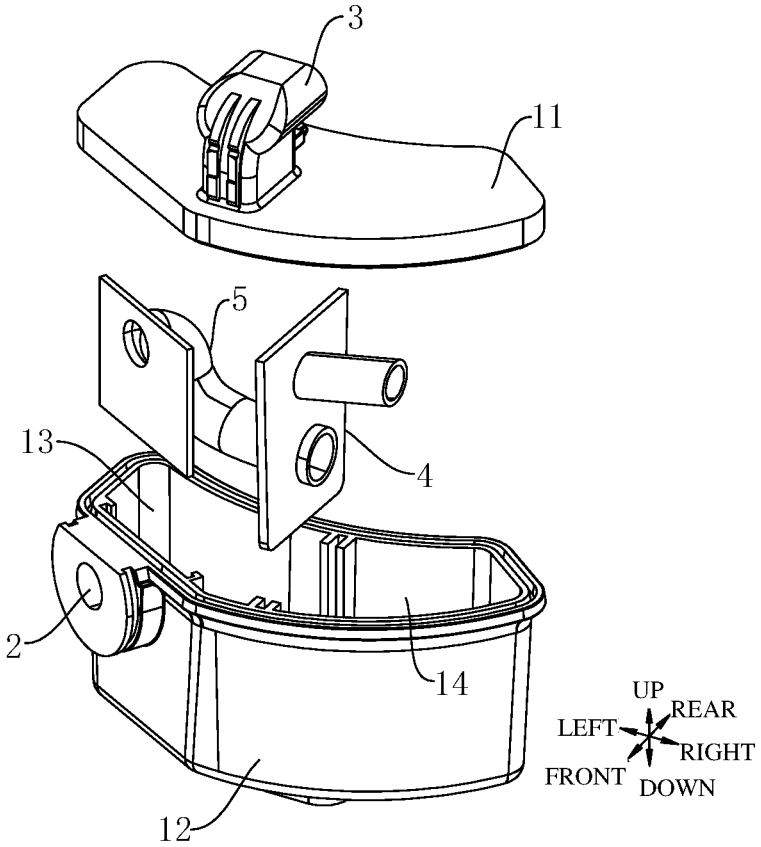
FIG. 2 is an exploded view of the suction muffler in FIG. 1.

The housing assembly 1 defines a cavity, and the housing assembly 1 is provided with a suction port 2 and a discharge port 3. Specifically, as illustrated in FIGS. 1 and 2, the housing assembly 1 has a front-rear direction, a left-right direction and an up-down direction. In the present embodiment, the suction port 2 is provided to a surface of a front side of the housing assembly 1, and runs through a front side wall of the housing assembly 1. The discharge port 3 is provided to a top surface of the housing assembly 1, and runs through a top wall of the housing assembly 1. In the present embodiment, an inside of the housing assembly 1 is the cavity, and the suction port 2 and the discharge port 3 separately communicate an outside of the housing assembly 1 with the cavity of the housing assembly 1.

At least one partition plate 4 is provided in the cavity to divide the cavity into at least two muffler cavities, and the at least two muffler cavities include a first muffler cavity 13 and a second muffler cavity 14. The at least one partition plate defines a penetrating hole to communicate the first muffler cavity 13 with the second muffler cavity 14. The discharge port 3 is in communication with the first muffler cavity 13, and the suction port 2 corresponds to the first muffler cavity 13.

For example, in the present embodiment, the partition plate 4 is provided in the cavity of the housing assembly 1, and the partition plate 4 divides the cavity of the housing assembly 1 into two muffler cavities. The two muffler cavities are the first muffler cavity 13 and the second muffler cavity 14 respectively. The partition plate 4 defines a penetrating hole 41, the penetrating hole 41 runs through the partition plate 4, and the first muffler cavity 13 and the second muffler cavity 14 are communicated with each other through the penetrating hole 41. In the present embodiment, the discharge port 3 is in communication with the first muffler cavity 13, and the suction port 2 is also in communication with the first muffler cavity 13. In the shown embodiment, the first muffler cavity 13 and the second muffler cavity 14 are substantially the same. It could be understood that, in some other embodiments, the discharge port 3 may also be in communication with the second muffler cavity 14. In the present embodiment, provision of the penetrating hole 41 in the partition plate 4 enables airflow in the second muffler cavity 14 to flow into the first muffler cavity 13 via the penetrating hole 41, and subsequently to be discharged via the discharge port 3.

It could be understood that, in some other embodiments, the cavity of the housing assembly 1 may be provided with two or more partition plates 4, and the two or more partition plates 4 divide the cavity of the housing assembly 1 into at least three muffler cavities. The at least three muffler cavities include the first muffler cavity 13 and the second muffler cavity 14. The first muffler cavity 13 is located at a left side of the housing assembly 1, the second muffler cavity 14 is located at a right side of the housing assembly 1, and the remaining muffler cavities are located between the first muffler cavity 13 and the second muffler cavity 14. In this case, each partition plate 4 between the first muffler cavity 13 and the second muffler cavity 14 defines a penetrating hole 41, and the first muffler cavity 13 and the second muffler cavity 14 are communicated with each other through the penetrating hole 41 in each partition plate 4.

At least a portion of the first tube 5 is provided in the first muffler cavity 13, an end of the first tube 5 is in communication with the suction port 2, and another end of the first tube 5 passes through the at least one partition plate 4 and is in communication with the second muffler cavity 14.

For example, in the present embodiment, the majority of the first tube 5 is located in the first muffler cavity 13, an end of the first tube 5 is coupled to a surface of an inner wall of the housing assembly 1 and in communication with the suction port 2. In order to prevent the airflow sucked through the suction port 2 from flowing into the first muffler cavity 13, in the present embodiment, the first tube 5 is sealingly coupled to the housing assembly 1. In the present embodiment, the other end of the first tube 5 passes through the partition plate 4 and is in communication with the second muffler cavity 14. In the present embodiment, the partition plate 4 defines a through hole for passage of the first tube 5. In order to prevent the airflow from flowing through a gap between the first tube 5 and the through hole, in the present embodiment, the first tube 5 is sealingly coupled to the partition plate 4.

It could be understood that, in some other embodiments, the housing assembly 1 may be internally provided with a plurality of partition plates 4, and the plurality of partition plates 4 are arranged sequentially along a direction from the first muffler cavity 13 to the second muffler cavity 14. In this case, the first tube 5 is configured to pass through each partition plate 4. In other words, one end of the first tube 5 is in communication with the suction port at the first muffler cavity 13, the other end of the first tube 5 is in communication with the second muffler cavity 14, and a middle portion of the first tube 5 passes through each muffler cavity between the first muffler cavity 13 and the second muffler cavity 14 sequentially.

In the suction muffler according to embodiments of the present disclosure, the provision of the first tube 5 enables the airflow sucked from the suction port 2 to directly flow into the second muffler cavity 14 via the first tube 5, to prevent the airflow from directly flowing into the first muffler cavity 13 adjacent to the suction port 2. As shown in FIGS. 2-5, first tube 5 is not straight from a first end of first tube 5 at suction port 2 to a second end of first tube 5 at second muffler cavity 14. Instead, first tube 5 includes a curvature to effect a three-dimensional change in direction. Hence, during the process of the airflow flowing along the first tube 5, the energy of the airflow will be consumed or dissipated to have an effect of weakening the airflow pulsation, reducing disturbance of the airflow pulsation at the suction port 2 to the airflow in the first muffler cavity 13, and reducing the vibration of the suction muffler. Thus, muffling effect of the suction muffler can be ensured.

Additionally, the arrangement form of the first tube 5, the partition plate 4, the first muffler cavity 13 and the second muffler cavity 14 in the present disclosure is an advantageous configuration that is obtained at least based on numerous and repetitive three-dimensional modeling and simulation tests. The arrangement form of the first tube 5 and the partition plate 4 in the present disclosure exhibits minor disturbance to the airflow in the muffler cavity and has satisfactory muffling effect in the simulation tests.

Figure 3:
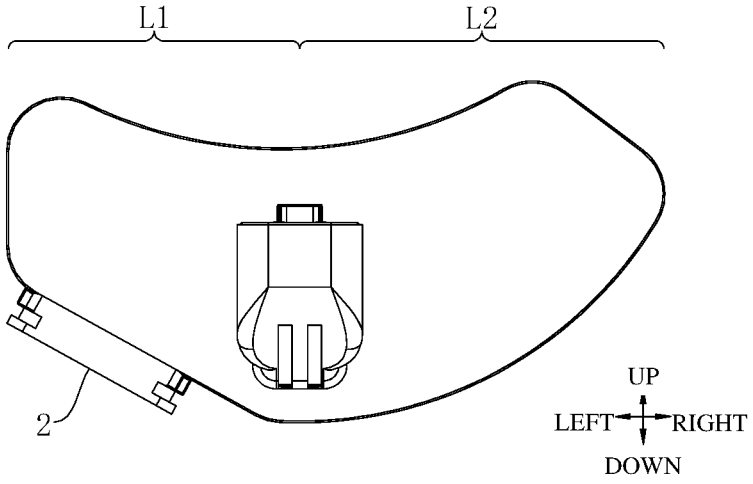
FIG. 3 is a top view of the suction muffler in FIG. 1.
Figure 4:
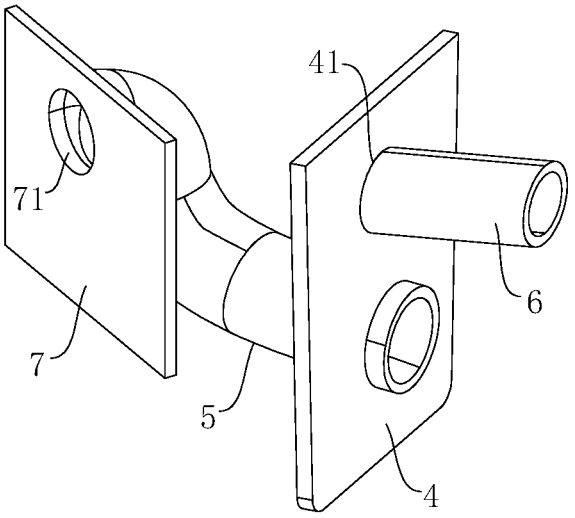
FIG. 4 is a schematic view of a partition plate and a first tube of the suction muffler in FIG. 1.

In some embodiments, as illustrated in FIGS. 2-4, the suction muffler also includes a second tube 6. At least a portion of the second tube 6 is provided in the second muffler cavity 14, an end of the second tube 6 is coupled to one partition plate 4, and the second tube 6 is in communication with the first muffler cavity 13 through the penetrating hole 41 in the at least one partition plate 4.

For example, in the present embodiment, major portion of the second tube 6 is located in the second muffler cavity 14, an end of the second tube 6 is coupled to the partition plate 4, and the second tube 6 is in communication with the first muffler cavity 13 through the penetrating hole 41 in the partition plate 4. The other end of the second tube 6 extends into the second muffler cavity 14, and the airflow in the second muffler cavity 14 can flow into the first muffler cavity 13 via the second tube 6. In the present embodiment, the provision of the second tube 6 enhances the effect of weakening the airflow pulsation, by further consuming the energy of the airflow. Thus, the muffling effect of the suction muffler can be further enhanced. In addition, in the present embodiment, the provision of the second tube 6 is also an advantageous configuration that is obtained at least based on numerous three-dimensional modeling and simulation tests. The suction muffler provided additionally with the second tube 6 has much minor disturbance to the airflow in the muffler cavity and has more satisfactory muffling effect in the simulation tests.

It could be understood that, in some other embodiments, the housing assembly 1 may be internally provided with a plurality of partition plates 4. The plurality of partition plates 4 divide the inner cavity of the housing assembly 1 into a plurality of muffler cavities, and the plurality of muffler cavities are arranged sequentially in the left-right direction. The plurality of muffler cavities include a first muffler cavity 13 and a second muffler cavity 14. The first muffler cavity 13 is located at a left side of the housing assembly 1, the second muffler cavity 14 is located at a right side of the housing assembly 1, and the remaining muffler cavities are located between the first muffler cavity 13 and the second muffler cavity 14. An end of the second tube 6 extends into the second muffler cavity 14, and the other end of the second tube 6 may be coupled to any one of the partition plates 4. For example, the other end of the second tube 6 may be directly coupled to the partition plate 4 at the leftmost side, and in this case the airflow from the second tube 6 flows directly into the first muffler cavity 13. The other end of the second tube 6 may also be coupled to the partition plate 4 at the rightmost side, and in this case the airflow from the second tube 6 flows into the first muffler cavity 13 via the penetrating holes 41 in the remaining partition plates 4 sequentially.

Figure 5:
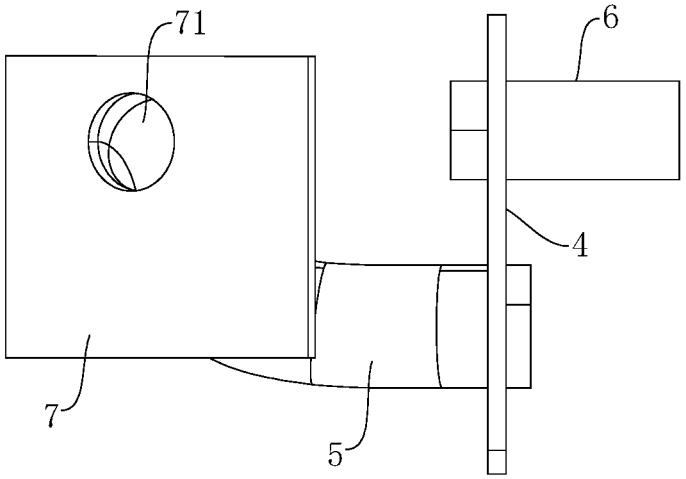
FIG. 5 is a front view of the partition plate and the first tube in FIG. 4.

In some embodiments, as illustrated in FIGS. 4 and 5, the first tube 5 is a circular tube, and an inner diameter of the first tube 5 is in a range of 6 mm-8 mm. Alternatively or additionally, the second tube 6 is a circular tube and an inner diameter of the second tube 6 is in a range of 6 mm-8 mm. For example, in the present embodiment, each of the first tube 5 and the second tube 6 is a circular tube, the inner diameter of the first tube 5 can be any value in the range of 6 mm-8 mm, e.g., 6 mm, 6.5 mm, 7 mm, 7.5 mm, 8 mm, etc.; and the inner diameter of the second tube 6 can be any value in the range of 6 mm-8 mm, e.g., 6 mm, 6.5 mm, 7 mm, 7.5 mm, 8 mm, etc. The individual range setting of the inner diameters of the first tube 5 and the second tube 6 is also an advantageous configuration that is obtained at least based on numerous three-dimensional modeling and simulation tests, and it has been discovered that the inner diameter of the first tube 5 and the inner diameter of the second tube 6, within 6 mm-8 mm, collectively provide unexpected result of the muffling effect. It could be understood that, in some other embodiments, one of the first tube 5 and the second tube 6 may be a non-circular tube. For example, the second tube 6 may be a square tube, a triangular tube, etc.

Figure 6:
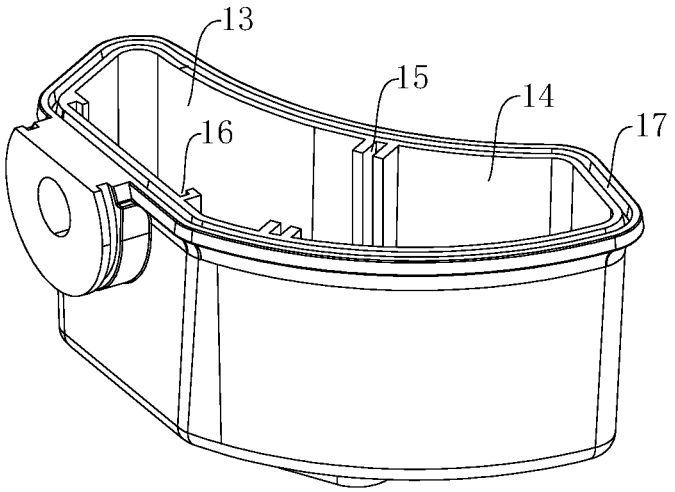
FIG. 6 is a schematic view of a barrel of a housing assembly of the suction muffler in FIG. 1.

In some embodiments, as illustrated in FIG. 6, the surface of the inner wall of the housing assembly 1 is provided with a first slot 15, and a portion of the partition plate 4 is fitted in the first slot 15. For example, in the present embodiment, the first slot 15 is provided to a surface of the inner wall of the housing assembly 1, and when mounting the partition plate 4, the partition plate 4 is directly inserted into the first slot 15, and an edge of the partition plate 4 is consequently embedded in the first slot 15, to implement plug-in mounting and fixing of the partition plate 4. The provision of the first slot 15 can facilitate mounting and detachment of the partition plate 4; meanwhile, the wall of the first slot 15 may be designed to protrude from the surface of the inner wall of the housing assembly 1, and in this case the first slot 15 can also act as a reinforcing rib, to enhance structural strength of the housing assembly 1.

In some embodiments, as illustrated in FIG. 4, an end portion of the first tube 5 is provided with a coupling member 7. The coupling member 7 is coupled to the housing assembly 1, the coupling member 7 defines a communication hole 71, and the communication hole 71 is configured to communicate the suction port 2 with the first tube 5. For example, in the present embodiment, the coupling member 7 is provided at an end of the first tube 5. The coupling member 7 is configured to be coupled and fixed to a surface of the inner wall of the housing assembly 1. The coupling member 7 defines the communication hole 71, and after the coupling member 7 is coupled and fixed to the surface of the inner wall of the housing assembly 1, the communication hole 71 communicates the first tube 5 with the suction port 2. In this way, the airflow sucked from the suction port 2 can directly flow into the first tube 5 via the communication hole 71. The provision of the coupling member 7 facilitates coupling and fixing of the first tube 5 and the surface of the inner wall of the housing assembly 1, and further facilitates mounting and detachment of the first tube 5.

In some embodiments, as illustrated in FIG. 6, a surface of the inner wall of the housing assembly 1 is provided with a second slot 16. A portion of the coupling member 7 is fitted in the second slot 16. For example, in the present embodiment, the second slot 16 is provided to the surface of the inner wall of the housing assembly 1, and when mounting the first tube 5, the coupling member 7 is inserted into the second slot 16 and an edge of the coupling member 7 is accordingly embedded in the second slot 16, to implement clamping and fixing of the coupling member 7, and further to realize coupling and fixing of an end of the first tube 5 and the housing assembly 1. The provision of the second slot 16 facilitates mounting and detachment of the coupling member 7; meanwhile fitting between the coupling member 7 and the second slot 16 also facilitates mating of the first tube 5 and the suction port 2. When the coupling member 7 is inserted into place, the mating of the first tube 5 and the suction port 2 can be implemented.

In some embodiments, as illustrated in FIG. 4, the discharge port 3 is in communication with the first muffler cavity 13, the suction port 2 is located below the discharge port 3, and in the up-down arrangement direction of the discharge port 3 and the suction port 2, an end portion of the first tube 5 coupled to the suction port 2 is higher than an end portion of the first tube 5 in communication with the second muffler cavity 14.

For example, in the present embodiment, the end of the first tube 5 configured to communicate with the suction port 2 is higher than the end of the first tube 5 configured to communicate with the second muffler cavity 14. By this configuration, a pressure at the end of the first tube 5 configured to communicate with the suction port 2 is greater than a pressure at the end of the first tube 5 configured to communicate with the second muffler cavity 14, such that the airflow flows into the second muffler cavity 14 via the first tube 5 conveniently. Additionally, this configuration is also an advantageous configuration that is obtained at least based on multiple three-dimensional modeling and simulation tests, and can further improve the muffling effect.

In some embodiments, as illustrated in FIG. 4, the suction port 2 is located below the discharge port 3, and in the up-down arrangement direction of the discharge port 3 and the suction port 2, the penetrating hole 41 is located above the end portion of the first tube 5 in communication with the second muffler cavity 14. For example, in the present embodiment, the penetrating hole 41 is higher than the end of the first tube 5 in communication with second muffler cavity 14, and this design renders the airflow in the second muffler cavity 14 to flow from bottom to top, to have an effect of further consuming the energy of the airflow, and to further ensure the muffling effect.

In some embodiments, as illustrated in FIG. 2, the housing assembly 1 includes a barrel 12 and a cover 11. A top of the barrel 12 is an opening, and the cover 11 is provided at the top opening of the barrel 12. The partition plate 4 and the first tube 5 are both provided in the barrel 12, the suction port 2 is provided to the barrel 12, and the discharge port 3 is provided to the cover 11.

For example, in the present embodiment, the housing assembly 1 has a split form, and the housing assembly 1 includes two parts of the barrel 12 and the cover 11. The barrel 12 has a barrel-like structure, and the top of the barrel 12 is an opening. The partition plate 4, the first tube and the second tube 6 may be placed in the barrel 12 via the top opening of the barrel 12, the cover 11 is provided at the top opening of the barrel 12, and the cover 11 is configured to seal and close the top opening of the barrel 12, to make the cavity of the housing assembly 1 a sealed cavity. In the present embodiment, the discharge port 3 is provided to the cover 11, the suction port 2 is provided to the barrel 12, and after the cover 11 is fixed to the barrel 12, the discharge port 3 is located above the suction port 2. The split form of the housing assembly 1 facilitates mounting and detachment of the partition plate 4, the first tube 5 and the second tube 6, and also facilitates processing of the housing assembly 1.

In some embodiments, as illustrated in FIG. 3, the first muffler cavity 13 has a first length in a direction from the first muffler cavity 13 to the second muffler cavity 14, the second muffler cavity 14 has a second length in the direction from the first muffler cavity 13 to the second muffler cavity 14, and a ratio of the first length to the second length is in a range of one-third to two-thirds.

For example, in the present embodiment, the first muffler cavity 13 and the second muffler cavity 14 are arranged sequentially in the left-right direction. In the left-right direction, the first muffler cavity 13 has a first length, the first length is a maximum length of the first muffler cavity 13 in the left-right direction, and the first length is L1 in FIG. 3; the second muffler cavity 14 has a second length, the second length is a maximum length of the second muffler cavity 14 in the left-right direction, and the second length is L2 in FIG. 3. In the present embodiment, a ratio of the first length L1 to the second length L2 may be any value from one-third to two-thirds, e.g., 0.35, 0.38, 0.4, 0.45, 0.5, 0.6, etc. The ratio of the first length to the second length set within the above range is an advantageous configuration that is obtained at least based on multiple three-dimensional modeling and simulation tests, and within the above value range, the suction muffler has satisfactory muffling effect.

In some embodiments, a bottom of the housing assembly 1 defines a drain hole (not illustrated), and the drain hole is in communication with the second muffler cavity 14. For example, since the suction muffler is coupled to a compressor when in operation, during reciprocating operation of the compressor, lubrication oil will be guided into the second muffler cavity 14 along the first tube 5. The provision of the drain hole facilitates the discharge of the lubrication oil in the second muffler cavity 14. It could be understood that, in some other embodiments, the bottom of the housing assembly 1 may define a plurality of drain holes, some of the drain holes are in communication with the first muffler cavity 13, and some others of the drain holes are in communication with the second muffler cavity 14. Such arrangement facilitates the discharge of the lubrication oil in the first muffler cavity 13 and the second muffler cavity 14.

A suction muffler according to an exemplary embodiment of the present disclosure will be described below with reference to FIGS. 1-6.

As illustrated in FIGS. 1 and 2, the suction muffler according to embodiments of the present disclosure includes a housing assembly 1, a partition plate 4, a first tube 5 and a second tube 6.

The housing assembly 1 defines a cavity, and the partition plate 4 is provided in the cavity of the housing assembly 1. In the present embodiment, the partition plate 4 is vertically arranged in the up-down direction, the partition plate 4 divides the cavity of the housing assembly 1 into two muffler cavities, and the two muffler cavities are a first muffler cavity 13 and a second muffler cavity 14 respectively. In the present embodiment, the first muffler cavity 13 and the second muffler cavity 14 are sequentially arranged in the left-right direction, and the first muffler cavity 13 is located at a left side of the second muffler cavity 14. In the present embodiment, the partition plate 4 defines a penetrating hole 41, the penetrating hole 41 runs through the partition plate 4, and the first muffler cavity 13 and the second muffler cavity 14 are communicated with each other through the penetrating hole 41.

The housing assembly 1 is provided with a suction port 2 and a discharge port 3. In the present embodiment, the suction port 2 is provided to a surface of the front side of the housing assembly 1, and runs through the front side wall of the housing assembly 1. The discharge port 3 is provided to the top surface of the housing assembly 1, and runs through the top wall of the housing assembly 1. In the present embodiment, the discharge port 3 is in communication with the first muffler cavity 13, and when the first tube 5 is not mounted in the housing assembly 1, the suction port 2 is also in communication with the first muffler cavity 13.

In the present embodiment, an end of the first tube 5 is sealingly coupled to a surface of the inner wall of the housing assembly 1 and is in communication with the suction port 2; and the other end of the first tube 5 passes through the partition plate 4 and is in communication with the second muffler cavity 14. In the present embodiment, the partition plate 4 defines a through hole for passage of the first tube 5, and the first tube 5 and the partition plate 4 are sealingly coupled. In the present embodiment, an end of the second tube 6 is coupled to the partition plate 4, and the second tube 6 is in communication with the first muffler cavity 13 through the penetrating hole 41 in the partition plate 4. The other end of the second tube 6 extends into the second muffler cavity 14, and thus, the airflow of the second muffler cavity 14 can flow into the first muffler cavity 13 via the second tube 6. In the present embodiment, each of the first tube 5 and the second tube 6 is a circular tube, an inner diameter of the first tube 5 is 7 mm, and an inner diameter of the second tube 6 is 6 mm.

In order to facilitate mounting of the partition plate 4, the first tube 5 and the second tube 6, as illustrated in FIG. 2, in the present embodiment, the housing assembly 1 has a split form, and the housing assembly 1 includes two parts of a barrel 12 and a cover 11. The barrel 12 has a barrel-like structure, a top of the barrel 12 has a top opening, and the partition plate 4, the first tube 5 and the second tube 6 can be placed in the barrel 12 via the top opening of the barrel 12. The cover 11 is provided at the top opening of the barrel 12, and the cover 11 is configured to seal and close the top opening of the barrel 12, to make each of the first muffler cavity 13 and the second muffler cavity 14 a sealed cavity. In the present embodiment, the discharge port 3 is provided to the cover 11, the suction port 2 is provided to the barrel 12, and after the cover 11 is fixed to the barrel 12, the discharge port 3 is located above the suction port 2.

In order to facilitate mounting and detachment of the partition plate 4, as illustrated in FIG. 6, in the present embodiment, a surface of an inner wall of the barrel 12 defines a first slot 15. The first slot 15 includes a first slot segment, a second slot segment and a third slot segment. Each of the first slot segment, the second slot segment and the third slot segment can be a U-shaped slot with a U-shaped cross section. The first slot segment is provided to a surface of a front inner wall of the barrel 12, the second slot segment is provided to a surface of a rear inner wall of the barrel 12, and the third slot segment is provided to a surface of a bottom inner wall of the barrel 12. In the present embodiment, the first slot segment and the second slot segment are arranged oppositely, a slot opening of the first slot segment and a slot opening of the second slot segment are both oriented towards the inside of the barrel 12. That is, the slot opening of the first slot segment is oriented rearwardly, and the slot opening of the second slot segment is oriented frontwardly. In the present embodiment, a top end of the first slot segment runs through a surface of a top end of the barrel 12, and a top end of the second slot segment runs through the surface of the top end of the barrel 12. In the present embodiment, an end of the third slot segment is coupled to the first slot segment, the other end of the third slot segment is coupled to the second slot segment, and a slot opening of the third slot segment is oriented upwardly. When mounting the partition plate 4, the partition plate 4 is vertically inserted downwardly through the top opening of the barrel 12, front and rear edges of the partition plate 4 will be inserted downwardly into the first slot segment and the second slot segment, respectively; after the partition plate 4 is slid downwardly into place, a bottom edge of the partition plate 4 will be inserted into the third slot segment, to realize the fixing of the partition plate 4.

In order to facilitate mounting and detachment of the first tube 5, as illustrated in FIG. 4, in the present embodiment, an end portion of the first tube 5 is provided with a coupling member 7. The coupling member 7 is provided at the first tube 5 and configured to communicate with an end of the suction port 2, and the coupling member 7 is configured to be coupled and fixed to a surface the inner wall of the barrel 12. The coupling member 7 defines a communication hole 71, and after the coupling member 7 is coupled and fixed to the surface of the inner wall of the barrel 12, the communication hole 71 communicates the first tube 5 with the suction port 2.

In the present embodiment, the coupling member 7 is a rectangular insertion plate, as illustrated in FIG. 6, a surface of the front inner wall of the barrel 12 is provided with a second slot 16. The second slot 16 includes a fourth slot segment and a fifth slot segment, and each of the fourth slot segment and the fifth slot segment is a U-shaped slot with a U-shaped cross section. In the present embodiment, the fourth slot segment and the fifth slot segment are arranged to extend in the up-down direction, and the fourth slot segment and the fifth slot segment are arranged oppositely. A slot opening of the fourth slot segment is oriented towards the fifth slot segment, and a slot opening of the fifth slot segment is oriented towards the fourth slot segment. In the present embodiment, a top end of the fourth slot segment runs through a surface of the top end of the barrel 12, and a bottom end of the fourth slot segment extends to a surface of an inner bottom of the barrel 12. Similarly, a top end of the fifth slot segment runs through the surface of the top end of the barrel 12, and a bottom end of the fifth slot segment extends to the surface of the inner bottom of the barrel 12. When mounting the first tube 5, the coupling member 7 is inserted into the second slot 16 from above, two side edges of the coupling member 7 will be snap-fitted into the fourth slot segment and the fifth slot segment, to implement the fixing of the coupling member 7, and to further facilitate mating and communication of the first tube 5 and the suction port 2.

In order to promote the muffling effect, in the present embodiment, an end of the first tube 5 configured to communicate with the suction port 2 is higher than an end of the first tube 5 configured to communicate with the second muffler cavity 14, and the penetrating hole 41 is higher than the end of the first tube 5 in communication with the second muffler cavity 14. That is, the second tube 6 is located above the end of the first tube 5 in communication with the second muffler cavity 14.

As illustrated in FIG. 3, in the left-right direction, in the present embodiment, the first muffler cavity 13 has a first length, the first length is a maximum length of the first muffler cavity 13 in the left-right direction, and the first length is L1 in FIG. 3; the second muffler cavity 14 has a second length, the second length is the maximum length of the second muffler cavity 14 in the left-right direction, and the second length is L2 in FIG. 3. In the present embodiment, a ratio of the first length L1 to the second length L2 is 0.6.

In order to facilitate mounting of the cover 11 onto the barrel 12, in the present embodiment, a surface of an annular top end of the barrel 12 defines a circle of third slot 17, and the third slot 17 is an annular slot in the top surface of the barrel 12. Correspondingly, the cover 11 is provided with an annular protrusion (not illustrated). When mounting, the cover 11 is snap-fitted with the top opening of the barrel 12, and the annular protrusion of the cover 11 will be inserted into the third slot 17, to realize insertion and snap-fitting assembly of the cover 11 and the barrel 12.

In order to facilitate outflow of the lubrication oil, in the present embodiment, a bottom of the barrel 12 further defines a drain hole, and the drain hole is in communication with the second muffler cavity 14.

When using the suction muffler according to the present embodiment, the airflow will be sucked into the first tube 5 from the suction port 2, flow into the second muffler cavity 14 along the first tube 5, into the first muffler cavity 13 via the second tube 6, and finally out of the first muffler cavity 13 via the discharge port 3. Since the airflow first flows into the second muffler cavity 14 away from the suction port 2, airflow pulsation has smaller influence, to ensure the muffling effect.

A suction muffler according to another exemplary embodiment of the present disclosure will be described below with reference to the accompanying drawings.

The suction muffler according to embodiments of the present disclosure includes a housing assembly 1, a partition plate 4, a first tube 5 and a second tube 6. The housing assembly 1, the partition plate 4, the first tube 5 and the second tube 6 may be the same as that of the above-described embodiments, and will not be repeated herein. The difference is that in the present embodiment, the first tube 5 is a circular tube, and an inner diameter of the first tube 5 is 8 mm; and the second tube 6 is a circular tube, and an inner diameter of the second tube 6 is 6 mm.

A suction muffler according to yet another exemplary embodiment of the present disclosure will be described below with reference to the accompanying drawings.

The suction muffler according to embodiments of the present disclosure includes a housing assembly 1, a partition plate 4, a first tube 5 and a second tube 6. The housing assembly 1, the partition plate 4, the first tube 5 and the second tube 6 may be the same as that of the above-described embodiments, and will not be repeated herein. The difference is that in the present embodiment, the first tube 5 is a circular tube, and an inner diameter of the first tube 5 is 5 mm; and the second tube 6 is a circular tube, and an inner diameter of the second tube 6 is 5 mm.

A suction muffler according to another exemplary embodiment of the present disclosure will be described below with reference to the accompanying drawings.

The suction muffler according to embodiments of the present disclosure includes a housing assembly 1, a partition plate 4, a first tube 5 and a second tube 6. The housing assembly 1, the partition plate 4, the first tube 5 and the second tube 6 may be the same as that of the above-described embodiments, and will not be repeated herein. The difference is that in the present embodiment, the housing assembly 1 is internally provided with a first muffler cavity 13 and a second muffler cavity 14, and a ratio of a first length L1 of the first muffler cavity 13 and a second length L2 of the second muffler cavity 14 is 0.5.

A suction muffler according to still another exemplary embodiment of the present disclosure will be described below with reference to the accompanying drawings.

The suction muffler according to embodiments of the present disclosure includes a housing assembly 1, a partition plate 4, a first tube 5 and a second tube 6. The housing assembly 1, the partition plate 4, the first tube 5 and the second tube 6 may be the same as that of the above-described embodiments, and will not be repeated herein. The difference is that in the present embodiment, the housing assembly 1 is internally provided with a first muffler cavity 13 and a second muffler cavity 14, and a ratio of a first length L1 of the first muffler cavity 13 and a second length L2 of the second muffler cavity 14 is 0.4.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," "counterclockwise," "axial," "radial" and "circumferential" should be construed to refer to the orientation as then described or as shown in the drawings under discussion. These relative terms are for convenience of description and do not require that the present disclosure be constructed or operated in a particular orientation.

In addition, terms such as "first" and "second" are used herein for purposes of description and are not intended to indicate or imply relative importance or significance. Thus, the feature defined with "first" and "second" may comprise one or more of this feature. In the description of the present disclosure, "a plurality of" means two or more than two, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, unless limited otherwise. the above terms can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature. While a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples. In addition, without conflicting, various embodiments or examples or features of various embodiments or examples described in the present specification may be combined by those skilled in the art.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A suction muffler comprising:

a housing assembly defining a cavity and comprising a suction port at a side wall surface of the housing assembly and a discharge port at a top surface of the housing assembly, the suction port being located below the discharge port in an up-down direction;

at least one partition plate provided in the cavity and configured to divide the cavity into at least two muffler cavities, the at least two muffler cavities comprising a first muffler cavity and a second muffler cavity, the at least one partition plate defining a penetrating hole to communicate the first muffler cavity with the second muffler cavity, the suction port corresponding to the first muffler cavity;

a first tube having at least a portion provided in the first muffler cavity, one end of the first tube being in communication with the suction port, the other end of the first tube passing through the at least one partition plate and being in communication with the second muffler cavity such that airflow flows into the second muffler cavity via the first tube, the first tube includes curvature to effect a three-dimensional change in direction so that energy of the airflow flowing along the first tube will be one of consumed or dissipated; and a second tube having at least a portion provided in the second muffler cavity, an end of the second tube being coupled to one of the at least one partition plate, and the second tube being in communication with the first muffler cavity through the penetrating hole in the at least one partition plate, wherein the discharge port is in communication with the first muffler cavity, the suction port is located below the discharge port in an up-down direction of the discharge port and the suction port, an end portion of the first tube coupled to the suction port is above an end portion of the first tube in communication with the second muffler cavity, and wherein airflow in the second muffler cavity flows from bottom to top to consume energy of the airflow.

2. The suction muffler according to claim 1, wherein the first tube comprises a circular tube, and an inner diameter of the first tube is in a range of 6 mm-8 mm.

3. The suction muffler according to claim 1, wherein the second tube comprises a circular tube, and an inner diameter of the second tube is in a range of 6 mm-8 mm.

4. The suction muffler according to claim 1, wherein a surface of an inner wall of the housing assembly is provided with a first slot, and a portion of the at least one partition plate is fitted in the first slot.

5. The suction muffler according to claim 1, wherein:

an end portion of the first tube is provided with a coupling member, the coupling member is coupled to the housing assembly, and the coupling member defines a communication hole configured to communicate the suction port with the first tube.

6. The suction muffler according to claim 5, wherein a surface of an inner wall of the housing assembly is provided with a second slot, and a portion of the coupling member is fitted in the second slot.

7. The suction muffler according to claim 1, wherein:

in an up-down direction of the discharge port and the suction port, the penetrating hole is located above an end portion of the first tube in communication with the second muffler cavity.

8. The suction muffler according to claim 1, wherein:

the housing assembly comprises a barrel and a cover, a top of the barrel comprises a top opening, the cover is provided at the top opening of the barrel, the partition plate and the first tube are both provided in the barrel, the suction port is provided to the barrel, and the discharge port is provided to the cover.

9. The suction muffler according to claim 1, wherein:

the first muffler cavity has a first length in a direction from the first muffler cavity to the second muffler cavity, the second muffler cavity has a second length in the direction from the first muffler cavity to the second muffler cavity, and a ratio of the first length to the second length is in a range of 1/3 to 2/3.

10. The suction muffler according to claim 1, wherein at least one of:

the coupling member is mountable to and detachable from the first tube, the partition plate is mountable to and detachable from both the first tube and the second tube, and the second tube is mountable to and detachable from the partition plate at the penetrating hole.

11. A suction muffler comprising:

a housing assembly defining a cavity and comprising a suction port and a discharge port;

at least one partition plate provided in the cavity and configured to divide the cavity into at least two muffler cavities, the at least two muffler cavities comprising a first muffler cavity and a second muffler cavity, the at least one partition plate defining a penetrating hole to communicate the first muffler cavity with the second muffler cavity, the suction port corresponding to the first muffler cavity; and a first tube having at least a portion provided in the first muffler cavity, one end of the first tube being in communication with the suction port, the other end of the first tube passing through the at least one partition plate and being in communication with the second muffler cavity, wherein an end portion of the first tube is provided with a coupling member, the coupling member is coupled to the housing assembly, and the coupling member defines a communication hole configured to communicate the suction port with the first tube, and wherein a surface of an inner wall of the housing assembly is provided with a second slot, and a portion of the coupling member is fitted in the second slot.

* * * * *